United States Patent [19]

Yang

[11] 4,349,123

[45] Sep. 14, 1982

[54] GARBAGE CAN WITH A PACKAGED AND FOLDED PLASTIC BAGS SUPPLIER

[75] Inventor: Yih-Chen Yang, Taipei, Taiwan

[73] Assignee: Chiang Keh-Yeu, Taipei, Taiwan

[21] Appl. No.: 129,576

[22] Filed: Mar. 12, 1980

[51] Int. Cl.[3] ..... B65D 25/10; B65D 25/16; B65F 1/06; B65F 1/08

[52] U.S. Cl. ..... 220/407; 206/390; 206/494; 206/554; 220/1 T; 220/404

[58] Field of Search ..... 93/32, 84 TW; 220/403, 220/404, 1 T, 407; 270/40, 39; 53/429, 553; 493/197, 217; 206/554, 494, 390

[56] References Cited

U.S. PATENT DOCUMENTS

| | | | |
|---|---|---|---|
| 1,385,569 | 7/1921 | Mayer et al. | 270/40 X |
| 1,425,071 | 8/1922 | Winter | 270/40 X |
| 1,480,236 | 1/1924 | Arelt | 270/40 X |
| 1,837,731 | 12/1931 | Smith | 270/40 |
| 3,300,082 | 1/1967 | Patterson | 220/407 X |
| 3,392,825 | 7/1968 | Gale et al. | 220/404 |
| 3,451,453 | 6/1969 | Heck | 220/1 T X |
| 3,485,413 | 12/1969 | Vestal | 206/554 X |
| 3,509,799 | 5/1970 | Weis et al. | 93/84 TW X |
| 3,701,522 | 10/1972 | Chi | 270/39 |

FOREIGN PATENT DOCUMENTS

| | | | |
|---|---|---|---|
| 888013 | 12/1971 | Canada | 220/404 |
| 8560 | 10/1978 | Taiwan . | |

*Primary Examiner*—Allan N. Shoap
*Attorney, Agent, or Firm*—Armstrong, Nikaido, Marmelstein & Kubovcik

[57] ABSTRACT

A garbage can with a packaged and folded plastic bags supplier, characterized in using a series of plastic bags which are packaged and folded in a box as a supplier for continuously supplying available plastic bags, relates to the structure of a garbage can and the special manner of sealing and folding the plastic bags as well.

1 Claim, 12 Drawing Figures

GARBAGE CAN WITH A PACKAGED AND FOLDED PLASTIC BAGS SUPPLIER

BACKGROUND OF THE INVENTION

Conventionally, a plastic bag is stretched and placed in a garbage can for holding of garbage and then, will be removed and replaced by another new bag when it is once filled with garbage. In this manner, spare bags have to be stored at some place other than in the garbage can. It may come to the situation that new bag is not available at the time that the bag in garbage can has been fully filled; or that the new bag is too large or too small for the can. Then, there is a certain degree of inconvenience.

The inventor has been trying to create a new structure of garbage can which can supply plastic bags by itself. Series plastic bags in roll available at the market have been tried for use, while the accompanied devices such as a live spindle for holding the series plastic bags in roll, and live spindle holders, which to be properly installed on the bottom of the garbage can, should be designed. However, such kind of structure has three significant disadvantages: First, the use of such a can is limited because its bottom should be larger than its opening for that the garbage can is in the shape of a cylinder, but the plastic bags in roll available at market are folded planely. Second, it is not easy to stretch the plastic bags, of which base is straightly sealed, into cylinderical form if the said plastic bags in roll are further folded for reducing their width. Third, if the live spindle is to be installed for holding of plastic bags in roll, the garbage can has to be drilled at its bottom walls or has to design a base device to hold the live spindle. Such a kind of structure does not meet the requirements for economization and compactness of a garbage can. Therefore, it is not practical. In consideration of the above disadvantages, the inventor created such an invention as described hereinafter for the purpose of promoting living standard and improving quality of daily utensils for human beings.

SUMMARY OF THE INVENTION

The main object of the present invention is to provide a structure of garbage can with a packaged and folded plastic bags supplier, for continuously suppling available plastic bags for using as the liners of a garbage can, whereof the filled plastic bag can be removed by tearing the perforated edge, and the subsequent plastic bag can be pulled up and stretched for using in turn.

Another object of the present invention is to provide a structure of packaged and folded plastic bags supplier which characterized in minimizing the dimension of the stored plastic bags, in providing a particular way of folding and sealing series plastic bags, and in assuring the folded and sealed plastic bags to be easily pulled out and easily stretched to serve as liners of a garbage can.

Still another object of the present invention is to provide a simple base structure of garbage can for holding the supplier of packaged and folded plastic bags in a compact and economic manner, and for the capability of being directly placed at the bottom of a garbage can.

DETAILED DESCRIPTION OF THE PREFERRED EMBODIMENT

Figure 1:
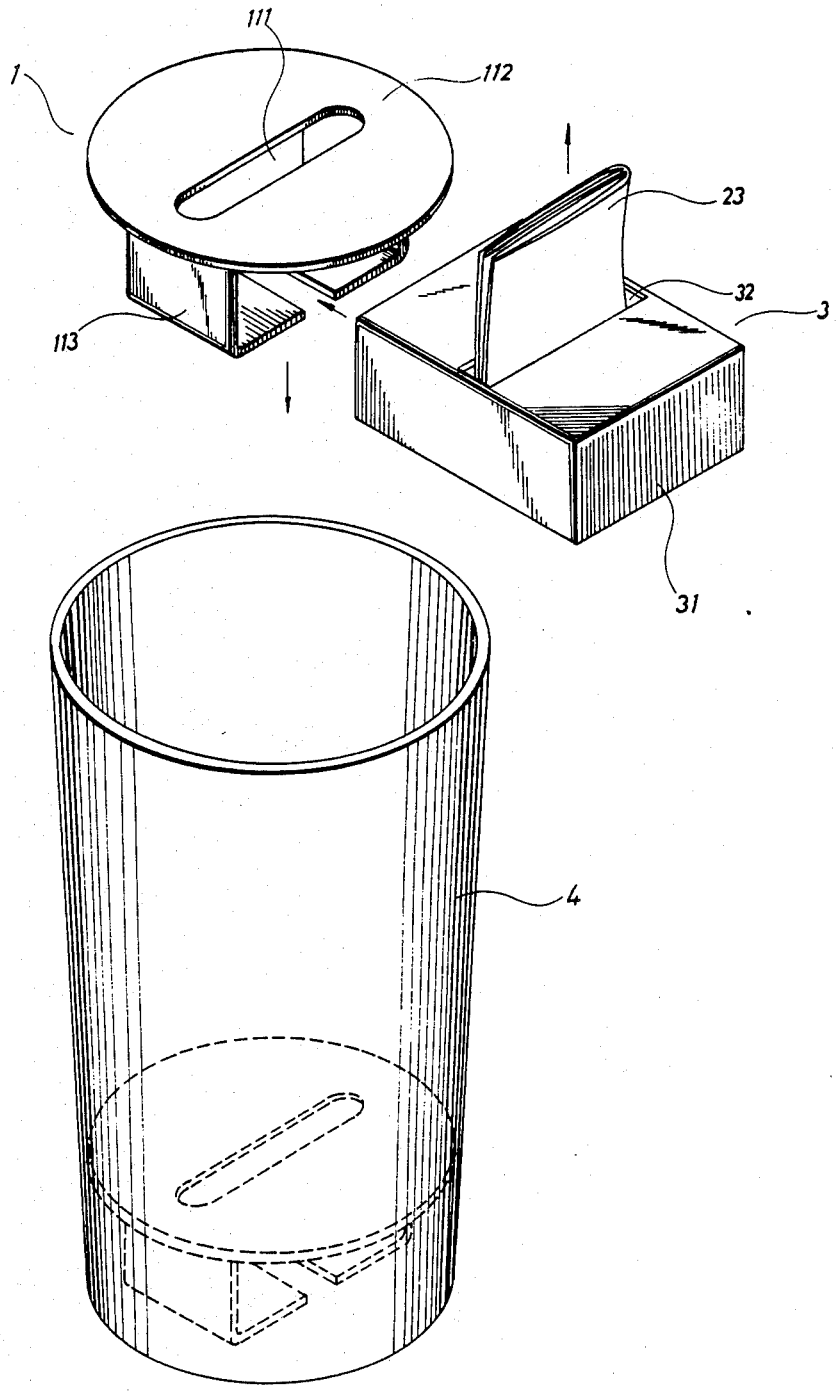
FIG. 1 is the perspective view showing the position and relation among the can body, packaged and folded plastic bags supplier and the base of the present invention.

As shown in FIG. 1, the invention consists of a can body (4), a series of packaged and folded plastic bags (3), a package box (31) and a base (1), wherein the base (1) is composed of an upper plate (112) and a base frame (113). There is a slot (111) on the upper plate (112). The length of the slot (111) is equal to the length of the slot (32) on the package box (31), which used as a supplier for the plastic bags (23), so that the plastic bags (23) in the package box (31) can be pulled out smoothly through the said slot (32) and the slot (111). The upper plate (112) has a cross section which is in the same shape with the lower part of a garbage can body (4) so that it can isolate the base frame (113) from the upper space of the can body (4). The base frame (113) is for holding of the package box (31) in which a series of packaged and folded plastic bags (3) are stored. Both of them are placed at the lower part of the can body (4). Such a disclosure teaches a simple and continuous self-supply bags structure for garbage can. The plastic bags placed in the base frame (1) can be pulled out without the using of spindle or any other means.

Figure 2:
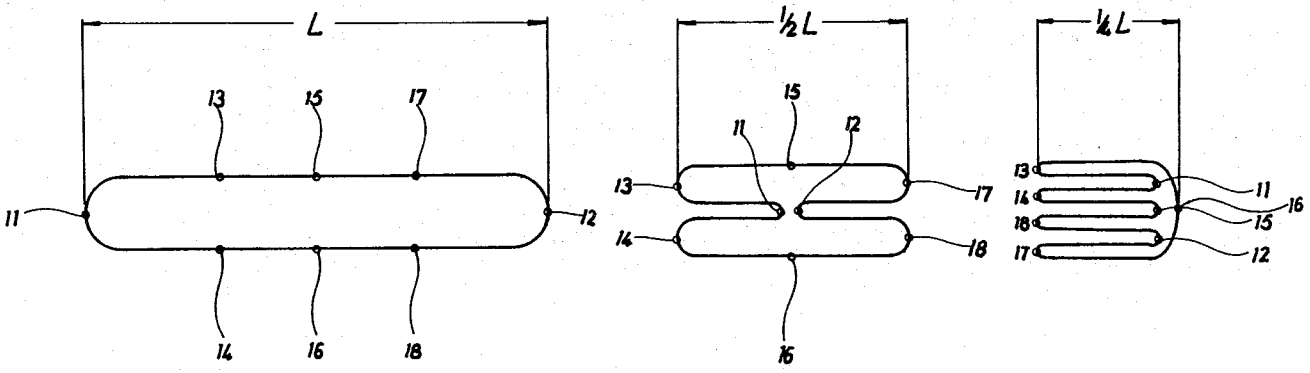
FIGS. 2(*a*), 2(*b*) and 2(*c*) depict the folding steps of packaged and folded bags of the present invention.
Figure 3:
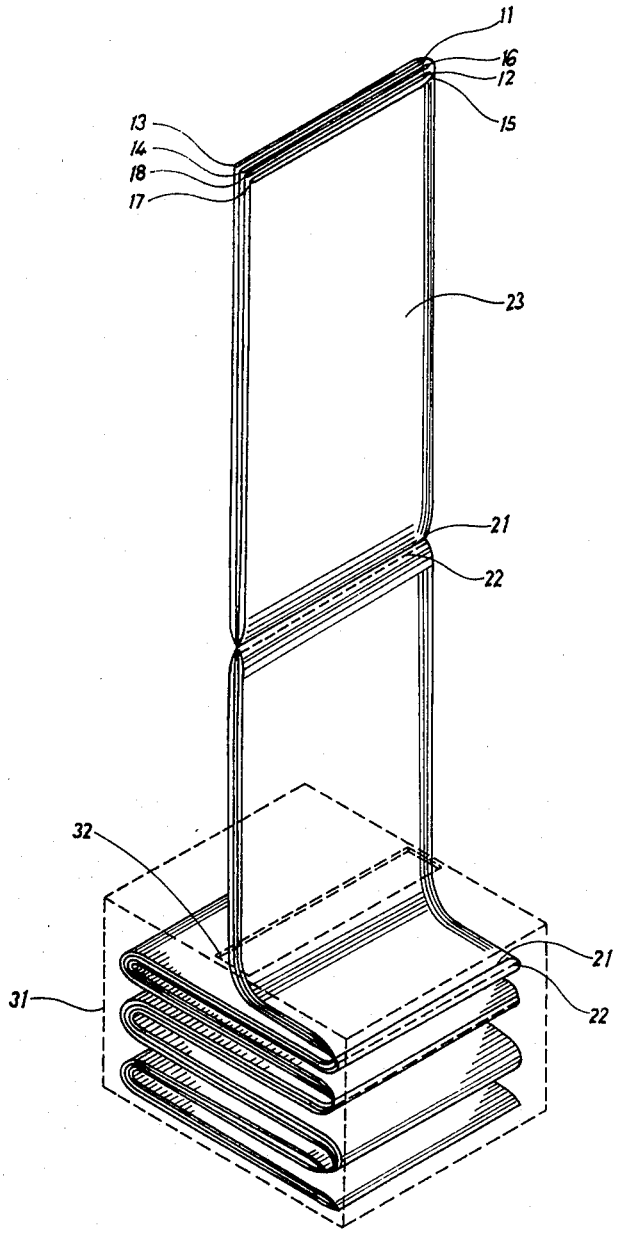
FIG. 3 is the perspective view showing the state of plastic bags being pulled up from its folded position.

With reference to the FIG. 2 (A), we suppose that the width of the opening edge of a plastic bag is L, then the steps of folding the bag as disclosed herein are as follows: Two symmetric points (11) and (12) are inserted in a manner as shown in FIG. 2 (B) so that points (11) and (12) contact each other. Then, the width become $\frac{1}{2}$ L. In the making process for the plastic bags to be used in the invention, the bags have to be sealed at this period between steps shown in FIG. 2 (B) and FIG. 2 (C) at the lower end (21) and perforated at line (22) as shown in FIG. 3. Then, floding process continues. Points (17) and (18) are folded so that they coincide with points (13) and (14) respectively as shown in FIG. 2 (C), then, the width becomes $\frac{1}{4}$ L.

As shown in FIG. 3, the series of sealed and folded plastics bags is packaged in package box (31) after step shown in FIG. 2 (C), and conversely, the folded plastic bags (23) can be pulled up through the slot (32) on the package box (31) one by one. The figure shows the sealed edge (21) and perforated line (22) which allow tearing of a bag from the series ones.

Figures 4A, 4B, 4C, 4D:
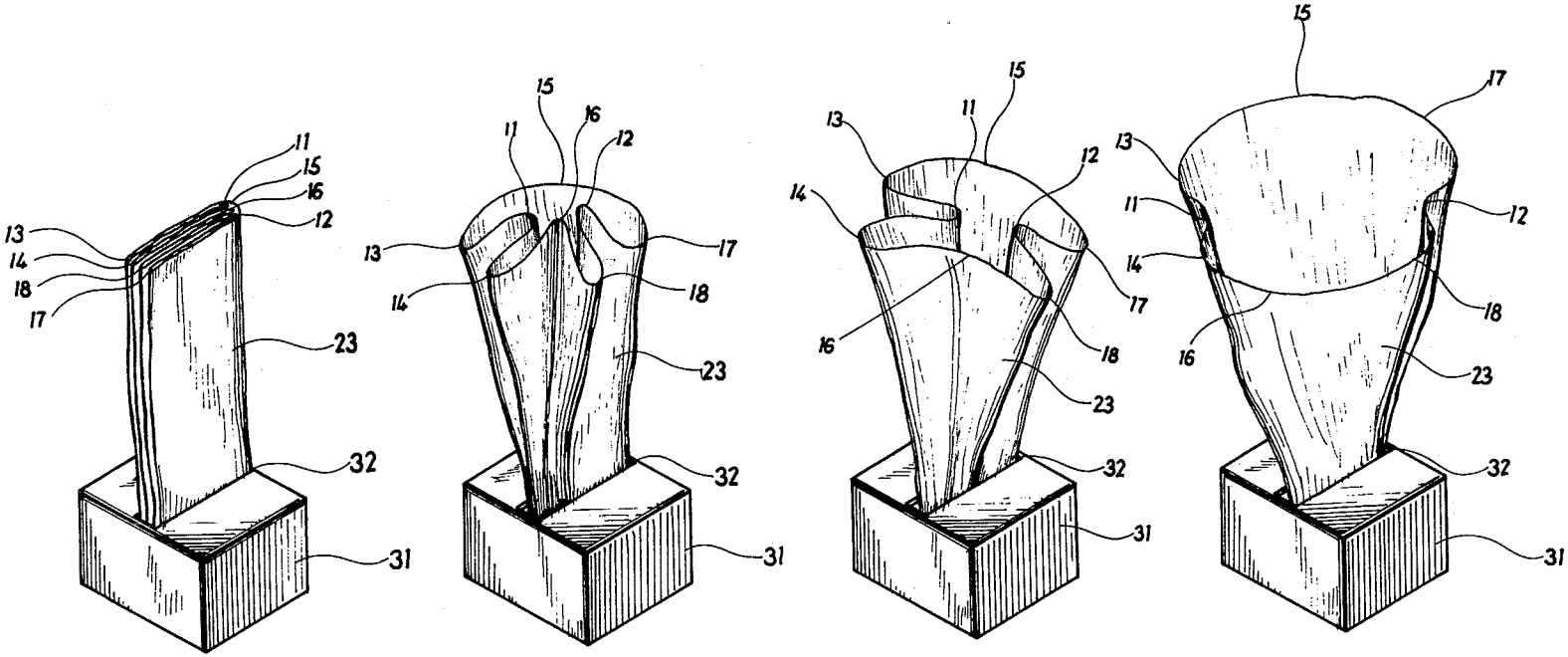
FIGS. 4(*a*), 4(*b*), 4(*c*) and 4(*d*) depict the steps in stretching a plastic bag of the present invention.

FIGS. 4 (A) through 4 (D) through illustrate the stretching steps of packaged and folded plastic bags. The distribution of the points (13), (14), (17) and (18) and points (11), (12), (15) and (16) explain the stretching steps of a folded bag for the purpose of using as a liner for a garbage can, further it shows the easiness of stretching operation.

Figure 7:
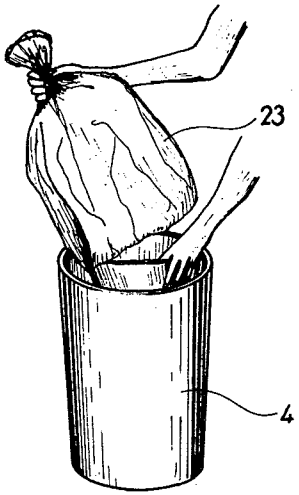
FIG. 5 through FIG. 7 depict the operation and function of the liners over can opening in the application of packaged and folded bags of the present invention.
Figure 6:
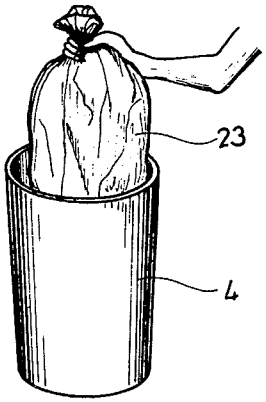
Figure 5:
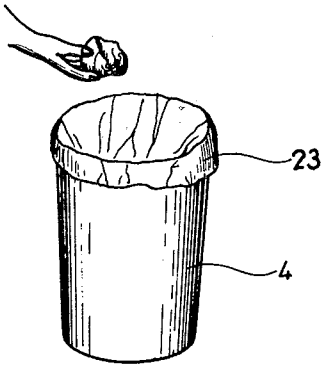

FIGS. 5 through 7 illustrate the function and operation of the packaged and folded plastic bags used as liners of a can body, also they describe the value of practical use of the present invention.

The base frame (1), upper plate (112) and can body (4) are not limited in the shape as described but in any other shape which is suitable for them to accompany together. All modifications which can easily be made in accordance with the creative spirit of the present invention should be considered within the scope of this invention defined in the claims hereof.

The invention was granted with a Copper and a Silver Medal Award at the International Inventions Show held at Nurnberg, W. Germany on Nov. 3, 1979.

I claim:

1. A garbage can with a packaged and folded plastic bags supplier, comprising:

a series of packaged and folded plastic bags stored in a package box, the said package box having a slot through which the said series of packaged and folded plastic bags can be pulled up;

a base composed of an upper plate and a base frame, said upper plate having a slot which is the same as the slot on said package box in length, said base frame comprising two L-shaped legs, each having an upright portion with a top end and a flat base portion, each top end being affixed to said upper plate and each flat base portion facing each other defining a space and support for holding said package box and assuring that said packaged and folded plastic bags can be pulled out smoothly through said slots on said upper plate and said package box;

a can body having suitable height and providing a space on its lower portion to hold said base, said base frame being completely isolated from the upper space of said can body by said upper plate.

* * * * *